United States Patent [19]

Lai

[11] Patent Number: 4,877,546

[45] Date of Patent: Oct. 31, 1989

[54] FOAM ENHANCING AGENT FOR LIGHT DUTY DETERGENT

[75] Inventor: Kuo-Yann Lai, Kendall, N.J.

[73] Assignee: Colgate-Palmolive Company, Piscataway, N.J.

[21] Appl. No.: 117,380

[22] Filed: Oct. 30, 1987

Related U.S. Application Data

[63] Continuation of Ser. No. 858,827, Apr. 29, 1986, abandoned, which is a continuation of Ser. No. 573,434, Jan. 24, 1984, abandoned, which is a continuation of Ser. No. 290,640, Aug. 6, 1981, abandoned.

[51] Int. Cl.[4] ..... C11D 3/22

[52] U.S. Cl. ..... 252/174.17; 252/173; 252/541; 252/545; 252/546; 252/550; 252/551; 252/554; 252/DIG. 13; 252/DIG. 14

[58] Field of Search ..... 252/541, 545, 546, 550, 252/551, 554, 174, 17, 173, DIG. 1, DIG. 2, DIG. 13, DIG. 14

[56] References Cited

U.S. PATENT DOCUMENTS 4,166,048 8/1979 Nishimura et al. ..... 252/547

*Primary Examiner*—Paul R. Michl
*Assistant Examiner*—Hoa Van Le
*Attorney, Agent, or Firm*—Richard J. Ancel; Robert C. Sullivan; Murray M. Grill

[57] ABSTRACT

A light duty liquid detergent containing about 0.1 to 0.6% of a nonionic hydroxypropyl guar gum derivative as the foam enhancing agent in an aqueous solution containing a maximum of 40%, preferably less than 35% of the ternary surfactant system comprising $C_8$–$C_{18}$ alkyl ethenoxy ether sulfate, $C_8$–$C_{18}$ alkyl sulfate and a betaine.

4 Claims, No Drawings

FOAM ENHANCING AGENT FOR LIGHT DUTY DETERGENT

This is a continuation of co-pending application Ser. No. 858,827 filed on 4/29/86, a continuation of application Ser. No. 573,434 filed on 1/24/84, a continuation of application Ser. No. 290,640 filed on 8/6/81 now all abandoned.

BACKGROUND OF THE INVENTION

The present invention relates to novel light duty liquid detergent compositions with enhanced foaming properties, containing small amounts of a nonionic hydroxypropyl guar gum derivative as the foam stability agent. More specifically, said detergent system comprises a ternary mixture of an alkyl ethenoxy ether sulfate, an alkyl sulfate and a betaine.

Foam boosters commonly used for conventional light duty liquid detergents are either amides or amine oxides. To achieve foam boosting effect, they have to be used at relatively high levels (3–6%).

The prior art is replete with light duty liquid detergent compositions containing mixtures of betaines and one or more anionic detergents as exemplified by U.S. Pat. No. 3,849,548, wherein is disclosed a multidetergent shampoo composition containing a betaine and a lauryl sulfate or a lauryl ether sulfate (Example 3 and Table III); U.S. Pat. No. 3,950,417, wherein is disclosed a high lathering multidetergent-containing composition comprising a betaine and an anionic surfactant such as an alkyl ether sulfate or an alkyl sulfate and a nonionic surfactant such as a polyoxyethylene sorbitan monolaurate; U.S. Pat. No. 3,996,146, wherein is disclosed an acidic shampoo formulation comprising a cationic resin, at least two anionic detergents, one of which is an alkyl ether sulfate, and a betaine; U.S. Pat. No. 4,009,256 which also discloses a shampoo composition comprising a cationic polymer, a betaine, and an alkyl ether sulfate (Example VI); U.S. Pat. No. 4,148,762 wherein is disclosed a detergent composition comprising a betaine and 5–30% anionic surfactants such as alkyl sulfate, alkyl ether sulfate and alkyl aryl ether sulfate; and U.S. Pat. No. 4,166,845, wherein is disclosed a high foaming antidandruff shampoo comprising a betaine and a supplemental detergent which may be an alkyl sulfate. Foaming of aforesaid compositions are a result of the use of the conventional foam boosters, or of the particular combination of detergents.

However, none of the above-mentioned patents disclose a liquid detergent composition containing the ternary mixture of a betaine, an alkyl sulfate and an alkyl ethenoxy ether sulfate.

U.S. Pat. No. 4,075,131 to Sterling, discloses a conditioning shampoo comprising an amphoteric surfactant such as a betaine, and a zwitterionic polymer, and may also contain foam boosters such as the alkanolamide (Example 1). The ternary mixture of alkyl sulfate, alkyl ether sulfate and betaine is disclosed herein (column 7) as a control concentrate for testing the effectiveness of the conditioning shampoo containing the zwitterionic polymer conditioning agent.

The prior art also discloses the use of hydroxyalkyl ethers of guar gum (a galactomannan gum) as thickening agents in printing pastes, paint dispersions and explosive slurries as shown in U.S. Pat. No. 3,748,201 and No. 3,700,612. However, the disclosed compositions do not include liquid detergent compositions.

The Jaguar catalogue by Stein-Hall and Company, Inc., discloses hydroxypropylated guar gum derivatives useful as thickening agents. Guar gum is chemically classified as a galactomannan, is a high molecular weight carbohydrate polymer or polysaccharide made up of many mannose and galactose units linked together (page 5 of catalogue).

Japanese Pat. Nos. 76 20,202 and 20,203 (1976) by Unitaka disclose the preparation of hydroxypropyl sugar or glucose and its use as a builder for detergents; and the preparation of hydroxyethyl starch or hydroxypropyl amylose and its use as a soil redeposition inhibitor for detergents, said detergent composition comprising a sodium salt of coconut alcohol sulfate ester, sodium carbonate and sodium sulfate. The particular example cited in these patents indicates that with the lauryl alcohol sulfate surfactant, the traditional builder, tripolyphosphate can be replaced by hydroxypropyl glucose and still maintain the detergency of the composition. The particular builder substitutes mentioned herein are hydroxyalkyl (ethyl, propyl and butyl) ethers of mono- and di-saccharides. However, there is no mention herein of guar gum or guar gum derivatives nor of foam stabilization.

SUMMARY OF THE INVENTION

It has now been found that the addition of small amounts of a nonionic hydroxypropyl guar gum derivative (0.01–1%) to a light duty liquid detergent comprising a ternary mixture of an alkyl ethenoxy ether sulfate, an alkyl sulfate and a betaine, significantly improves the foam stability, cleaning efficiency and consistency of said liquid detergent.

Accordingly, the object of the invention is to provide novel light duty liquid detergent compositions containing small amounts of a nonionic hydroxypropyl guar gum derivative as a foam stabilizer and thickening agent.

Another object of this invention is to provide a novel liquid detergent composition containing a reduced amount of detergent active ingredients with improved foaming and cleaning performance.

Still another object of this invention is to provide a novel liquid detergent with enhanced foaming properties and a viscosity of at least 100 centipoises, comprising the ternary mixture of an alkyl ether sulfate, an alkyl sulfate and a betaine.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the novel light duty liquid detergent composition of this invention comprises a ternary mixture of the surfactants alkyl ethenoxy ether sulfate, alkyl sulfate and betaine and about 0.01–1%, preferably 0.1–0.6% of a nonionic hydroxypropyl guar gum derivative.

Accordingly, the present invention relates to a light duty liquid detergent composition having good foam stability consisting essentially of 0.01 to 1%, preferably 0.025–0.6% and most preferably 0.1 to 0.6% by weight of a nonionic hydroxypropyl guar gum derivative, in an aqueous vehicle containing a maximum of 40%, preferably a maximum of 35% by weight of a detergent active system comprising a water soluble ternary mixture of a $C_8$–$C_{18}$ alkyl ethenoxy ether sulfate, a $C_8$–$C_{18}$ alkyl sulfate and a betaine. Formulations containing as low as 22% active ingredients are capable of maintaining foaming and cleaning performance in the presence of small amounts of the hydroxypropyl guar gum derivative.

The foam booster utilized in instant invention which also functions as a thickening agent is a nonionic hydroxypropyl guar gum derivative. Aforesaid derivative is prepared by hydroxypropylating the guar molecule, whic is a straight chain mannan branched at quite regular intervals with single membered galactose units on alternate mannose units, as disclosed in aforesaid Jaguar catalogue by the Stein-Hall Company. The hydroxypropylated guar gum derivatives utilized in the present invention are water soluble, dry, particulate, carbohydrate materials having a particle size such that a minimum of 90% passes through a 140 mesh U.S. standard sieve and an MS (moles of substitution) value in the range of 0.2 to 0.8, preferably from 0.3 to 0.65. Generally, 1% aqueous solutions thereof have a pH in the range of 5 to 11 and a viscosity of about 3000 to 4000 cps measured on a Brookfield RVF viscometer using a No. 3 spindle rotating at 20 RPM at a temperature of 25° C., and the resultant solutions are thixotropic as viscosity changes with shearing stress. Suitable hydroxypropyl guar gum derivatives may be obtained from Stein-Hall Company under the names Jaguar ®HP 60, Jaguar ®HP 8 and Jaguar ®HP 11, which usually contain 5–13%, preferably 8–10% of moisture as received.

The hydroxypropyl guar gum derivatives are known to have thickening properties in aqueous solutions. However, a thickening agent is not generally known to improve the foaming properties of aqueous solutions containing surfactants, whereas the hydroxypropyl guar gum derivative defined above, both increases the viscosity of a detergent formulation as well as improves its foaming performance. Since foam volume and foam stability are often used to guage the cleaning efficiency, it is desirable to formulate a detergent composition with improved foaming performance. Another advantageous feature of instant novel detergent compositions containing said hydroxypropyl guar gum derivative, is that this foam booster has a thickening function which allows reduction in the active ingredient level of a formulation, yet maintains its foam performance, thereby effecting a saving in the cost of making this light duty liquid detergent product. Still another advantage is that smaller amounts of this foam booster (0.01–1% as opposed to 3–6%) are needed compared to conventional foam boosters, further reducing the cost of said detergent product.

It has additionally been found that the nonionic hydroxypropyl guar gum derivative functions as a foam stabilizer for certain detergent systems and has no effect on the foam performance of other systems such as linear alkyl benzene sulfonate/alkyl ether sulfate, or linear alkyl benzene sulfonate/alkyl ether sulfate/lauric-myristic monoethanol amide. Accordingly, it has been found that the particular detergent system wherein foam performance is significantly improved by the presence of said nonionic guar gum derivative is a ternary mixture comprising an alkyl ethenoxy ether sulfate, an alkyl sulfate and a betaine. Thus, it is evident that the specific detergent system utilized with the nonionic hydroxypropylated guar gum derivative is critical in order to obtain a light duty liquid detergent having significantly improved foam performance.

The essential components of this light duty liquid detergent comprise a water soluble $C_8$–$C_{18}$ alkyl ethenoxy ether sulfate and an ammonium or alkali metal salt of a $C_8$–$C_{18}$ alkyl sulfate, both of which are anionic surfactants; and a betaine, preferably an amidobetaine, which is a zwitterionic surfactant, dissolved in an aqueous vehicle. The betaine component constitutes about 2–3% and not more than 5% by weight of the liquid detergent composition, and the anionic surfactants constitute preferably about 20–30% by weight of the liquid composition with the ratio of alkyl ethenoxy ether sulfate to alkyl sulfate being non-critical. Ratios of 1/29 to 29/1 of the alkyl sulfate to alkyl ethenoxy ether sulfate, and preferably 17/13 to 12/8 respectively, may be utilized in present invention.

The anionic surfactants which may be used in the detergent composition of the invention include at least one surfactant selected from the group consisting of water soluble salts, e.g., the sodium, potassium, ammonium and alkanolammonium salts, of a $C_8$–$C_{18}$ alkyl sulfate, and preferably $C_{12}$–$C_{16}$ and $C_{12}$–$C_{15}$ alkyl sulfates, such as the lauryl sulfates, myristyl sulfates and the like; and at least one surfactant selected from the group consisting of the water soluble alkyl ethenoxy ether sulfates having the general formula $R(CH_2CH_2O)_nOSO_3M$, wherein R is an alkyl radical having 8–18 carbon atoms, n is an integer having the value of 1–12 and preferably 1–5, and M is an alkali metal, ammonium or alkylolammonium, such as lauryl triethenoxy ether sulfate, tridecyl alcohol triethenoxy ether sulfate, and the like. Other anionic surfactants such as the sodium lauryl sarcosinates, alkyl sulfonates, alkyl benzene sulfonates and lauryl alcohol sulfate or the like cannot be substituted for either of the above two groups of anionic surfactants as a component in the ternary detergent system of present invention, to produce a liquid product with improved foam performance.

The betaine component of instant liquid detergent composition has the general formula:

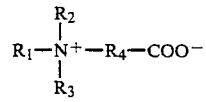

wherein $R_1$ is an alkyl group having 10 to about 20 carbon atoms, preferably 12 to 16 carbon atoms or the amido radical:

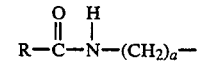

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N,N-dimethylammonio) acetate, coco dimethyl betaine or 2-(N-coco-N,N-dimethylammonio) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethyl betaine, cocoamidopropyl betaine, and the like.

All of the aforesaid components in this light duty detergent are water soluble and remain water soluble during storage.

This particular combination of anionic sulfates and betaine provides a ternary detergent system which coacts with the nonionic hydroxypropyl guar gum derivative to produce a liquid detergent composition with desirable foaming, foam stability, detersive properties as well as desirable viscosity characteristics. The resultant homogeneous liquid detergent exhibits superior foam performance as compared to the same detergent composition without the nonionic guar gum derivative as shown in the following Table I, using the Tergotometer foam test, wherein soiled planchets (1" diameter and ⅛" high), each containing one gram Crisco soil, are added in timed increments (every 2 minutes), to a 0.1% aqueous test solution of 150 ppm hardness as $CaCO_3$ ($Ca/Mg=2/1$), and 100 ppm alkalinity as $HCO_3^-$, at a temperature of 50° C., and agitated at 75 rpm for one minute. The foam level is recorded when the agitation is turned off after each addition of planchets, and the total number of planchets required to kill the foam is recorded.

TABLE I

| Detergent Formulation | | Number of Planchets Washed |
|---|---|---|
| 1. 17/13/3 | AEOS/ALS/Betaine | 19 |
| 2. 17/13/3/0.3 | AEOS/ALS/Betaine/Jaguar HP-60 | 22 |
| 3. 12/8/2 | AEOS/ALS/Betaine | 16 |
| 4. 12/8/2/0.5 | AEOS/ALS/Betaine/Jaguar HP-60 | 19 |

AEOS = Ammonium $C_{12}-C_{15}$ Alkyl $(C_2H_4O)_3$ Sulfate
ALS = Ammonium Lauryl Sulfate
Betaine = Coco Amido Propyl Betaine
Jaguar HP-60 = hydroxypropyl guar gum derivative (9% $H_2O$)

In addition, the addition of the Jaquar HP-60 to formula 3 increased its viscosity by 18 times, from 22.5 to 407.5 cps using a Brookfield Viscometer RVF, Spindle No. 1, 20 RPM and a solution temperature of 25° C. Furthermore, soil removal performance, as an evaluation of cleaning efficiency was not adversely affected by the presence of said guar gum derivative thickening agent as shown in Table II, using a static soaking test. A soil-containing planchet (0.5 g soil), as in the aforedefined foam performance test, which has been aged for 1½ min., is soaked for 30 sec. in a warm (50° C.) aqueous test solution of 150 ppm hardness and 100 ppm alkalinity and containing 0.1% detergent, and is immediately transferred to an ice-water bath to stop the soil removing process. The unremoved soil is solidified on the planchet which is air dried and % SR (soil removal) is calculated as:

$$\% SR = \frac{\text{Amount of Soil Removed}}{\text{Original Amount of Soil}} \times 100\%.$$

TABLE II

The Effect of Thickening Agent on Cleaning Performance

| | % SR (Soil Removal) | | |
|---|---|---|---|
| Formulation | Crisco | Tallow | Keen (shortening) |
| 1 | 94.4 | 77.2 | 50.6 |
| 2 | 96.0 | 78.0 | 50.6 |
| 3 | 94.8 | 80.4 | 52.6 |
| 4 | 96.6 | 78.4 | 51.6 |

In addition to the previously mentioned essential constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; preservatives such as formaldehyde or hydrogen peroxide; pearlescing agents and opacifiers; pH modifiers; hydrotropes such as ammonium or sodium xylene sulfonate, ethyl alcohol; citric acid; etc. The proportion of such adjuvant materials, in total, will normally not exceed 15% of the detergent composition. The percentages of most of such individual components will be a maximum of 5% and preferably less than 5%.

The present light duty liquid detergents such as dishwashing liquids are readily made by simple mixing methods from readily available components which, on storage, do not adversely affect the entire composition. However, it is essential that the guar gum derivative be added slowly and with agitation to the preformed aqueous solution containing the ternary surfactant system. The ternary surfactant system is prepared by adding with agitation an aqueous solution of alkyl sulfate and then betaine to an aqueous solution of an alkyl ethenoxy ether sulfate which may have been previously mixed with a hydrotropic agent such as ethyl alcohol and/or xylene sulfonate to assist in solubilizing said surfactant, and then adding with agitation the rest of the water to form the aqueous solution of the ternary surfactant system. The use of mild heating (up to 100° C.) assists in the solubilization of the surfactants. The viscosities are adjustable by changing the total percentage of active ingredients and by modifying the percentage of the thickening-foaming agent, hydroxypropyl guar gum derivative. In all such cases the product made will be pourable from a relatively narrow mouth bottle (1.5 cm. diameter) or opening, and the viscosity of the detergent formulation will not be so low as to be like water. The viscosity of the detergent should be at least 100 cps at room temperature, and up to about 1,000 centipoises. Its viscosity may approximate those of commercially acceptable detergents now on the market. The detergent viscosity and the detergent itself remain stable on storage for lengthy periods of time, without color changes or settling out of any insoluble materials. The pH of this formulation is preferably neutral, about 6 to 8.

These products have unexpectedly desirable properties. For example, the foam quality is superior to standard light duty liquid detergents while using a smaller active ingredient content.

DETAILED DESCRIPTION OF THE INVENTION

The following examples are merely illustrative of the invention and are not to be construed as limiting thereof.

EXAMPLES 1 and 2

| Ingredients | Example 1 | Example 2 |
|---|---|---|
| HP-60[1] | 0 | 0.5 g |
| Citric acid | 0 | 1.0 g |
| Deionized water | 36.06 g | 34.56 g |
| Alkyl ether sulfate[2] (AEOS, 58.3% AI) | 20.6 g | 20.6 g |
| Ethyl alcohol | 5 g | 5 g |
| Ammonium xylene sulfonate (40% AI) | 5 g | 5 g |
| Ammonium lauryl sulfate | 26.67 g | 26.67 g |

-continued

| Ingredients | Example 1 | Example 2 |
|---|---|---|
| (ALS, 30% AI) | | |
| Cocoamidopropylbetaine (30% AI) | 6.67 g | 6.67 g |

[1]nonionic hydroxypropyl guar gum derivative (9% $H_2O$)
[2]ammonium $C_{12}-C_{15}$ alkyl $(C_2H_4O)_3$ sulfate The ratio of the surfactants AEOS/ALS/Betaine is 12/8/2.

The AEOS, alcohol and ammonium xylene sulfonate are mixed together until homogeneous and clear, at room temperature or at slightly elevated temperatures (a maximum of 100° C.). The ammonium lauryl sulfate and the betaine are then added with agitation, followed by the addition of the water, while agitating the mixture to form an aqueous solution of the ternary surfactant system. In Example 2, the guar gum derivative and citric acid, which assists in the dissolution of said guar gum, are added lastly and slowly with agitation. The resultant product is a thickened solution with no sign of particulate suspension or precipitation.

Tergotometer foam tests on Crisco soil using test solutions of Examples 1 and 2 showed that 16 planchets were washed with the formulation of Example 1, and 19 planchets were washed with Example 2 (containing the guar gum derivative), which represents a significant improvement in the foaming performance (the foam lasted until planchet 19). It was additionally noted that soils in the buckets containing the composition of Example 1 (without the guar gum derivative) started to appear on the top of the solution faster (after the addition of the $8^{th}$ planchet) than in the buckets containing the solution of Example 2. The viscosity of Example 1 is 22.5 centipoises, which is too watery for a suitable consumer product; whereas the viscosity of Example 2 is 407.5 centipoises, which is within the range of a suitable light duty liquid detergent product.

Variations in the above formulations may be made. For example, other alkyl sulfates may be substituted for the ammonium lauryl sulfate such as sodium lauryl sulfate, potassium lauryl sulfate, the ammonium, sodium and potassium myristyl sulfates and the like. Similarly, other alkyl ethenoxy ether sulfates may be substituted for the ammonium alkyl ethenoxy ether sulfate such as sodium and potassium alkyl ethenoxy ether sulfate and the like. Likewise, other betaines may be substituted for the cocoamidopropyl betaine such as cocoamidoethylbetaine, cocobetaine and the like.

In addition, the amounts of each of the anionic components may be varied provided the sum total of said specific groups of anionic surfactants constitutes about 20–30% by weight of the composition. The amount of betaine may also be varied up to a maximum of about 5% by weight of the composition. The amount of the nonionic hydroxypropyl guar gum derivative may also be varied between 0.01 to about 1% and preferably 0.025–0.6% by weight of the composition, depending on the desired viscosity of the resultant liquid detergent product. A composition containing 1% of said guar gum derivative has been found to result in too viscous a product.

The invention has been described with respect to various examples and embodiments but is not to be limited to these because it is evident that one of skill in the art with the present application before him will be able to utilize substitutes and equivalents without departing from the spirit of the invention.

I claim:

1. A light duty, liquid detergent composition in an aqueous solution consisting essentially of: (a) 0.1% to 1.0% by weight of a nonionic hydroxypropyl guar gum derivative; and (b) a ternary mixture of a water-soluble salt of an anionic $C_8-C_{18}$ alkyl ethenoxy ether sulfate containing 1 to 12 ethenoxy groups in the molecule, a water-soluble salt of a $C_8-C_{18}$ alkyl sulfate surfactant, the weight ratio of said alkyl sulfate to said alkyl ethenoxy ether sulfate being from 1:29 to 29:1, and a zwitterionic betaine surfactant of the formula:

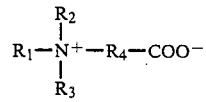

wherein $R_1$ is an alkyl group having 10 to 20 carbon atoms or the amido radical

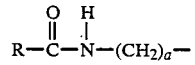

wherein R is an alkyl group having 9 to 19 carbon atoms and a is an integer from 1 to 4; $R_2$ and $R_3$ are $C_1-C_3$ alkyl; and $R_4$ is an alkylene or hydroxyalkylene group having 1 to 4 carbon atoms, said ternary mixture being present in an amount of approximately 20% to 40% by weight of the composition with said betaine constituting 2% to 5% by weight of the composition, said composition having a viscosity of from at least 100 cps. to 1000 cps. at room temperature and exhibiting enhanced foaming properties as compared with the same composition without said nonionic guar gum.

2. A liquid detergent composition in accordance with claim 1, wherein the zwitterionic surfactant is an amidobetaine.

3. A liquid detergent composition in accordance with claim 2, wherein the amidobetaine is cocoamidopropylbetaine.

4. A liquid detergent composition in accordance with claim 1, wherein the anionic alkyl sulfate is ammonium lauryl sulfate.

* * * * *